US007967234B2

(12) United States Patent
Baugh

(10) Patent No.: US 7,967,234 B2
(45) Date of Patent: Jun. 28, 2011

(54) METHOD FOR AUTOMATIC SLIP CLUTCH TENSION ON A REEL

(76) Inventor: Benton F. Baugh, Houston, TX (US)

( * ) Notice: Subject to any disclaimer, the term of this patent is extended or adjusted under 35 U.S.C. 154(b) by 22 days.

(21) Appl. No.: 12/459,634

(22) Filed: Jul. 7, 2009

(65) Prior Publication Data

US 2011/0006150 A1 Jan. 13, 2011

(51) Int. Cl.
*B65H 75/30* (2006.01)
*B65H 75/38* (2006.01)
*B65H 59/04* (2006.01)

(52) U.S. Cl. ..... 242/396.9; 242/421.2; 242/421.4; 242/422.2; 242/563.2; 166/77.1; 166/355

(58) Field of Classification Search ..... 242/421.2, 242/421.4, 422.2, 563, 563.2, 419, 419.2, 242/419.3, 396.5, 396.9; 166/77.1, 355
See application file for complete search history.

(56) References Cited

U.S. PATENT DOCUMENTS

| | | | | | |
|---|---|---|---|---|---|
| 2,694,300 | A | * | 11/1954 | Cherigie | 464/24 |
| 4,410,297 | A | | 10/1983 | Lynch | |
| 4,697,408 | A | * | 10/1987 | Kohata et al. | 57/264 |
| 4,743,175 | A | | 5/1988 | Gilmore | |
| 4,767,073 | A | | 8/1988 | Malzacher | |
| 5,190,410 | A | | 3/1993 | Nunley | |
| 5,275,198 | A | | 1/1994 | Vollweiler | |
| 5,373,925 | A | * | 12/1994 | Handford et al. | 191/12.2 A |
| 5,950,953 | A | | 9/1999 | Baugh | |
| 6,443,431 | B1 | | 9/2002 | Stasny | |
| 7,363,968 | B1 | | 4/2008 | Baugh | |

* cited by examiner

*Primary Examiner* — William E Dondero

(57) ABSTRACT

The method of preventing over tension to an umbilical wrapped on the spool of an offshore reel when the umbilical is being normally deployed or retrieved or when the umbilical is unexpectedly pulled from the spool on the reel, comprising providing a main disk, mounting the main disk on the spool of the reel with a slip connection which will be automatically controlled, connecting motor power for the reel to the main disk, connecting brakes to the main disk, such that when the diameter of deployment varies the slip connection torque will be automatically adjusted and prevent the umbilical from being subjected to tension higher than the desired amount.

22 Claims, 7 Drawing Sheets

METHOD FOR AUTOMATIC SLIP CLUTCH TENSION ON A REEL

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention of that of umbilical reels which store and handle hose and/or electric and/or fiber optic control lines for deepwater offshore service. These reels typically pay out these lines, called umbilicals, and mechanics clamp the umbilical to a drilling riser or other pipe string being run to the seafloor. The actual weight of the umbilical is typically supported once it leaves the reel and in the water by the riser or pipe to which it is clamped. Typically these reel units have to be closely monitored to insure that excessive tension which can destroy the umbilical is not encountered as it is being deployed or in the event of unexpected movement of the riser or pipe to which it is clamped.

When the drilling riser or other pipe string is lowered, an operator will rotate the spool to allow umbilical to be paid off in accordance with the downward movement of the riser or pipe. In some cases, the motor can be left in the take up mode, and the umbilical simply be pulled off the spool against a relatively constant torque provided by the motor power.

The spool portion of a reel can typically be locked into position by the brakes, the motor, or a manual locking pin.

A danger to the umbilical or reel can occur in the event that the drilling riser or other pipe string to which the umbilical is attached is lowered while the reel spool is locked in position. The reel spool can be locked in position because someone forgot to release the locking pin, the brakes are set, or the motor is locked. When this happens, an umbilical worth hundreds of thousands of dollars can be destroyed by the excessive tension and personnel can be injured.

Alternately, if the riser and umbilical are being deployed and the air pressure which runs the reel is lost, the failsafe brakes will automatically lock creating a chance that excessive tension will destroy the umbilical before the condition is recognized.

A slip clutch has sometimes been added to the reel to allow the spool to turn when a relatively fixed preset tension limit on the umbilical is exceeded. The spool holds several layers of umbilical and as successive layers of umbilical are deployed the spooling diameter decreases and this effect causes the tension on the umbilical to increase because the preset torque remains fixed. As offshore services are required in deeper water the length of umbilical deployed from the reels increases and this causes the diameter differential between a fully loaded spool and a fully deployed spool to increase thus multiplying the maximum tension on the umbilical during deployment. A fixed preset torque which provides a tension of 1,000 pounds on the umbilical when the spool is fully loaded can vary to over 3,000 pounds when the spool is nearly empty.

BRIEF SUMMARY OF THE INVENTION

The object of this invention is to provide a method for automatically controlling the slipping torque on a motorized offshore reel to provide a constant tension on an umbilical as it is being deployed.

A second object of the present invention is to provide a method of counting the revolutions of the spool during the umbilical deployment, determining the current radius to the cable being deployed, and automatically controlling the slipping torque in a fashion to maintain a constant tension limit on the umbilical.

A third object of the present invention is to utilize said means for automatically controlling slippage torque to apply maximum torque in an emergency.

Another object of the present invention is to provide means to calibrate the slipping torque on the reel in actual field conditions.

DETAILED DESCRIPTION OF THE INVENTION

Figure 1:
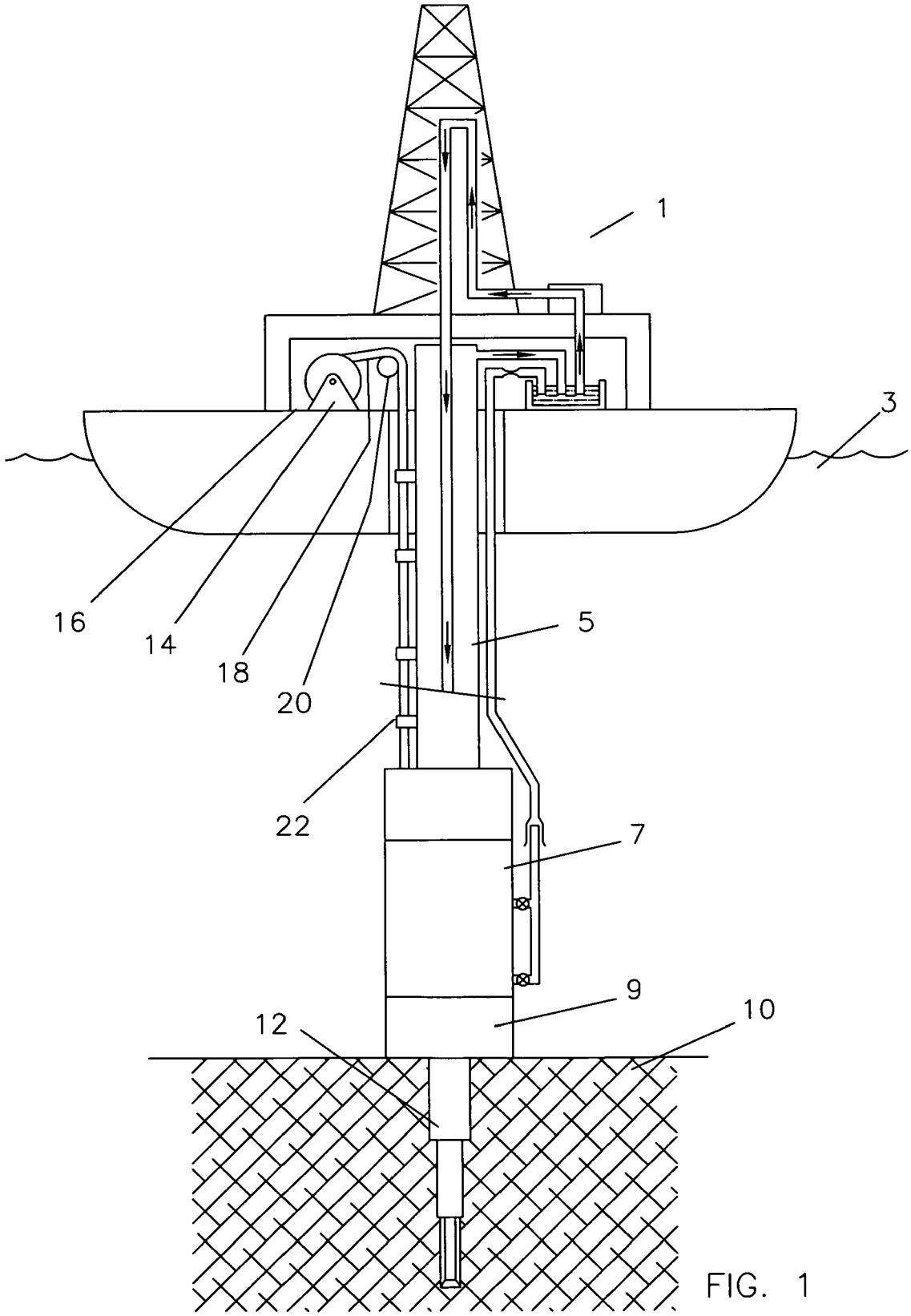
FIG. 1 is a view of a reel of this invention on the deck of a deepwater floating vessel, showing the umbilical clamped to a drilling riser.

FIG. 1 shows a vessel 1 floating on the ocean 3 and having a drilling riser 5 extending down toward a blowout preventer stack 7. The blowout preventer stack 7 is landed on a subsea wellhead 9 which is in turn landed on the seafloor 10. Casing 12 extends into the seafloor below the subsea wellhead 9 for the purpose of drilling an oil or gas well.

Reel 14 is positioned on the deck 16 of vessel 1 with umbilical 18 extending over pulley or sheave 20 and going down the side of the riser 5. Riser 5 is a series of jointed pipes and as they are sequentially connected and lowered into the ocean to lower the blowout preventer stack 7, clamps 22 secure the umbilical 18 to the drilling riser 5. The riser 5 and blowout preventer stack 7 may weigh as much as 650,000 lbs. When lowered with the umbilical 18 attached, if the rotation of the reel 14 is stopped, the full 650,000 lb. load can be put on the umbilical, destroying it. An even worse consequence is that the pulley or sheave 20 can be pulled down from its mounting and injure personnel on the deck.

Figure 2:
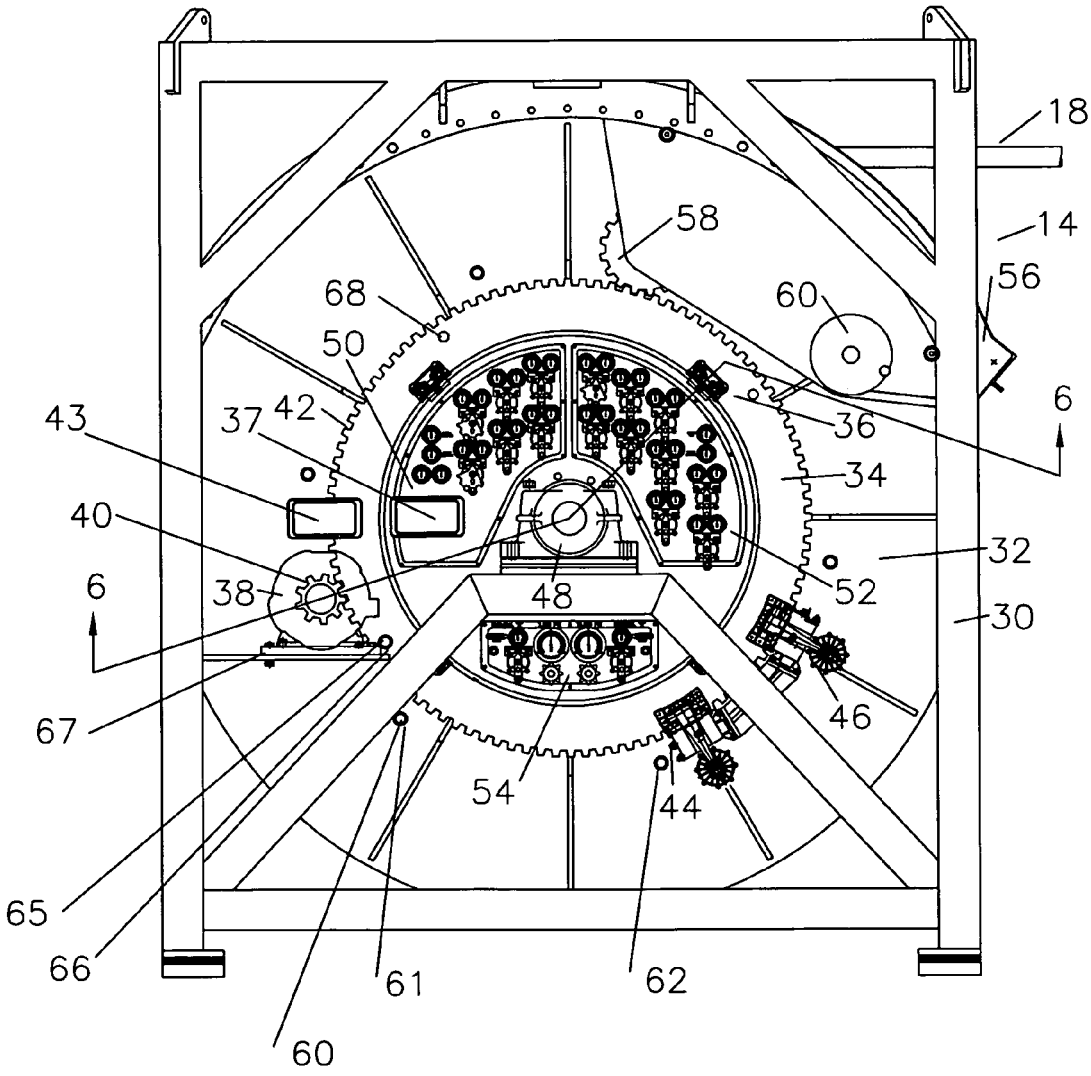
FIG. 2 is an end view of a reel of this invention.

Referring now to FIG. 2, reel 14 is shown with a frame 30 and a spool 32. Main disk 34 is shown mounted to the spool 32 by four slip clutch assemblies 36. As will be seen later, the slip clutch assemblies 36 provide a preset friction grip on the main disk 34 to withstand torque as the spool 32 rotates, but will be allowed to slip if the preset friction grip is exceeded when a large tension on the umbilical 18 is encountered. A slip torque controller 37 is located on the side of the spool 32 which automatically adjusts the control pressure to the slip clutch assemblies 36 as the spool 32 rotates allowing the friction grip on the main disk 34 to vary to maintain a relatively constant slip tension on the umbilical 18 as successive layers of umbilical 18 leave the reel 14 at different distances from the spool 32 centerline.

Motor 38 is shown with gear 40 (shown through the motor for clarity) engaging the outer gear profile 42 on the perimeter of main disk 34. Gear 40 and the outer gear profile 42 are positively engaged such that if the motor 38 does not turn, the main disk 34 cannot rotate. Alternately, the connection between the motor and the main disk can be by roller chain and sprocket profiles, as is well understood in the industry. A motor torque controller 43 is located next to the motor 38 which adjusts the air pressure to the motor 38 as the spool 32 rotates to maintain a relatively constant tension on the umbilical 18 as the umbilical 18 leaves the reel 14.

Brake assemblies 44 and 46 are caliper or disk brake assemblies which are spring loaded to engage when air pressure is released. If the air pressure is released from these brakes, the brakes will close and the main disk 34 will not rotate about the centerline of spool 32.

Spool 32 rotates on main bearings 48. Panels 50, 52, and 54 provide valves for remote control functions at the end of the umbilical. Levelwind 56, as will be seen in FIG. 3, has gear 58 to receive motive power from the main disk 34 and a manual clutch and handle 59 which allows for adjustment of the wrapping position of the umbilical.

Locking pin 60 is engaged in locking pin socket 61 which is fixed to a leg 62 of the reel frame 30. Locking pockets 62 are provided on the side of spool 32 for engaging locking pin 60 to positively stop the rotation of the spool 32. When locking pin 60 is an instrumented load pin, it can be engaged and give a positive reading of the torque output of the motor.

Locking pin 65 is engaged in locking pin socket 66 which is fixed to the motor mount 67 on the frame 30. One or more holes 68 are drilled through the main disk 34. When locking pin 65 is engaged in a hole 68, the main disk 34 will not rotate. When locking pin 65 is an instrumented load pin, it can be engaged to give a positive reading of the slipping force when the umbilical 18 is pulled, as long as the brakes 44 and 46 are released and the motor 38 is allowed to free wheel.

Figure 3:
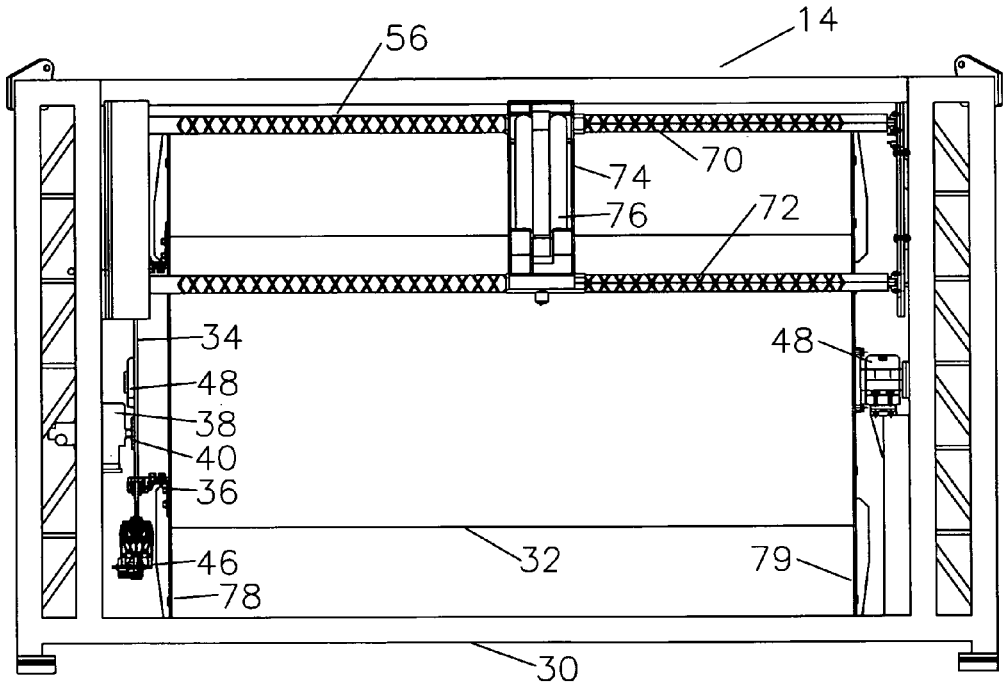
FIG. 3 is a front view of a reel of this invention.

Referring now to FIG. 3, levelwind 56 is shown having on a pair of diamond pattern screws 70 and 72 much like on an ordinary fishing reel. Level wind carriage 74 contains rollers 76 for controlling the position of the umbilical 18 (not shown) when it is being reeled in. Spool 32 has side flanges 78 and 79.

Figure 4:
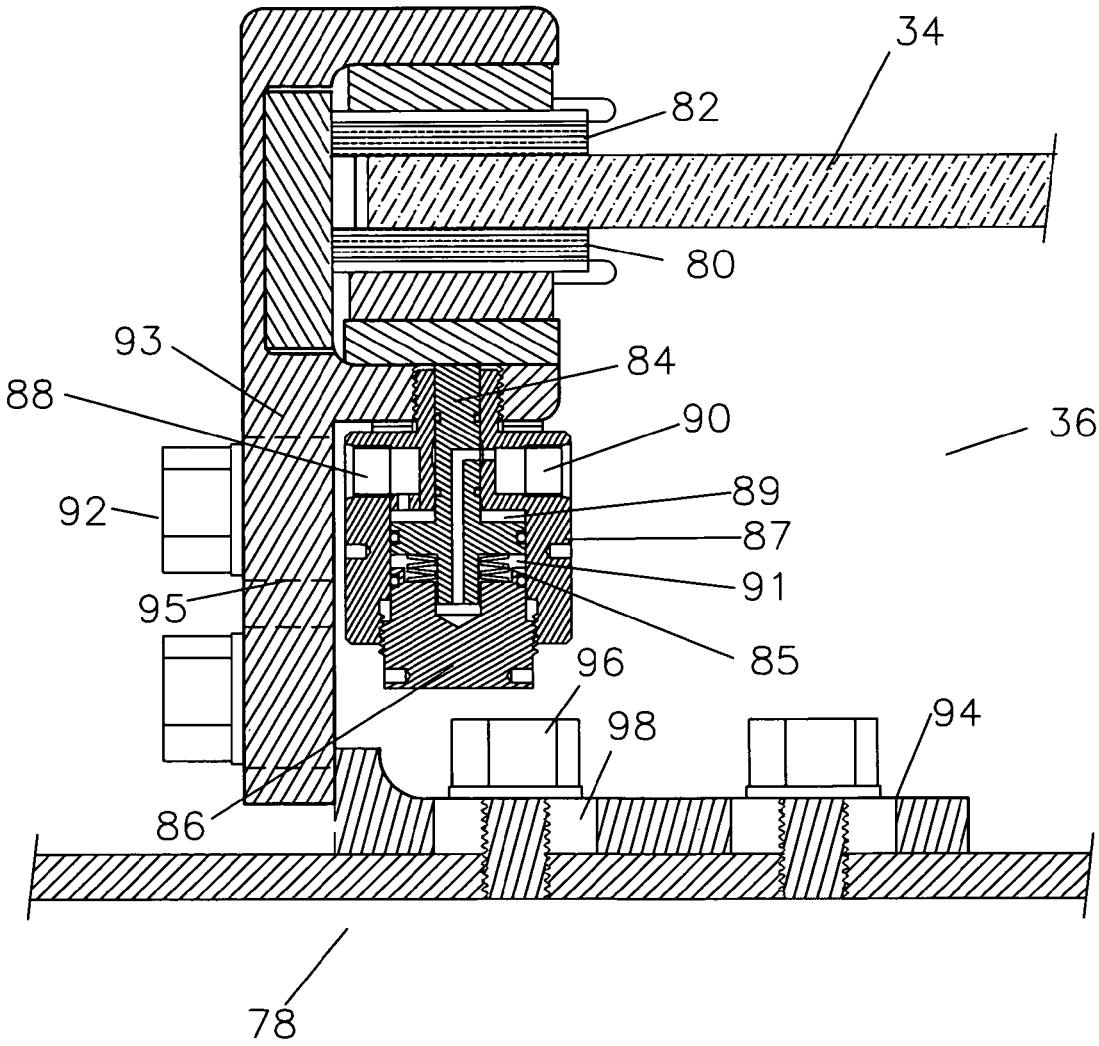
FIG. 4 is a section of a slip clutch assembly of this invention.

Referring now to FIG. 4, a slip clutch assembly 36 is shown with brake pads 80 and 82 which will be utilized to friction clamp onto the main disk 34. Piston 84 cooperates with conical springs 85 to manually preload the brake pad 80 onto the main disk 34. Main disk 34 is pushed against brake pad 82 and imparts the same load to brake pad 82. Cylinder head 86 seals the cylinder 87 allowing the piston 84 to be operated.

Pressure in pressure port 90 controls the air pressure in chamber 91 to increase the friction load of brake pad 80 onto main disk 34 and therefore of main disk 34 onto brake pad 82. This allows the friction grip on the main disk 34 to be increased when a higher slipping load is desired.

Pressure in pressure port 90 controls the air pressure in chamber 91 to increase the friction load of brake pad 80 onto main disk 34 and therefore of main disk 34 onto brake pad 81. This allows the friction grip on the main disk 34 to be increased when a higher slipping load is desired.

Bolts 92 attach bracket 93 to bracket 94 in a portion in front of and behind the cylinder 87 (not shown). Slots 95 allow for position adjustment of bracket 93 relative to bracket 94 in a first direction. Bolts 96 bolt bracket 94 to the side flange 78 of the spool. Slot 98 allows for adjustment of the slip clutch assembly 36 along the surface of the side flange 78 of the spool generally in a direction 90 degrees to the adjustment allowed by slots 95.

Figure 5:
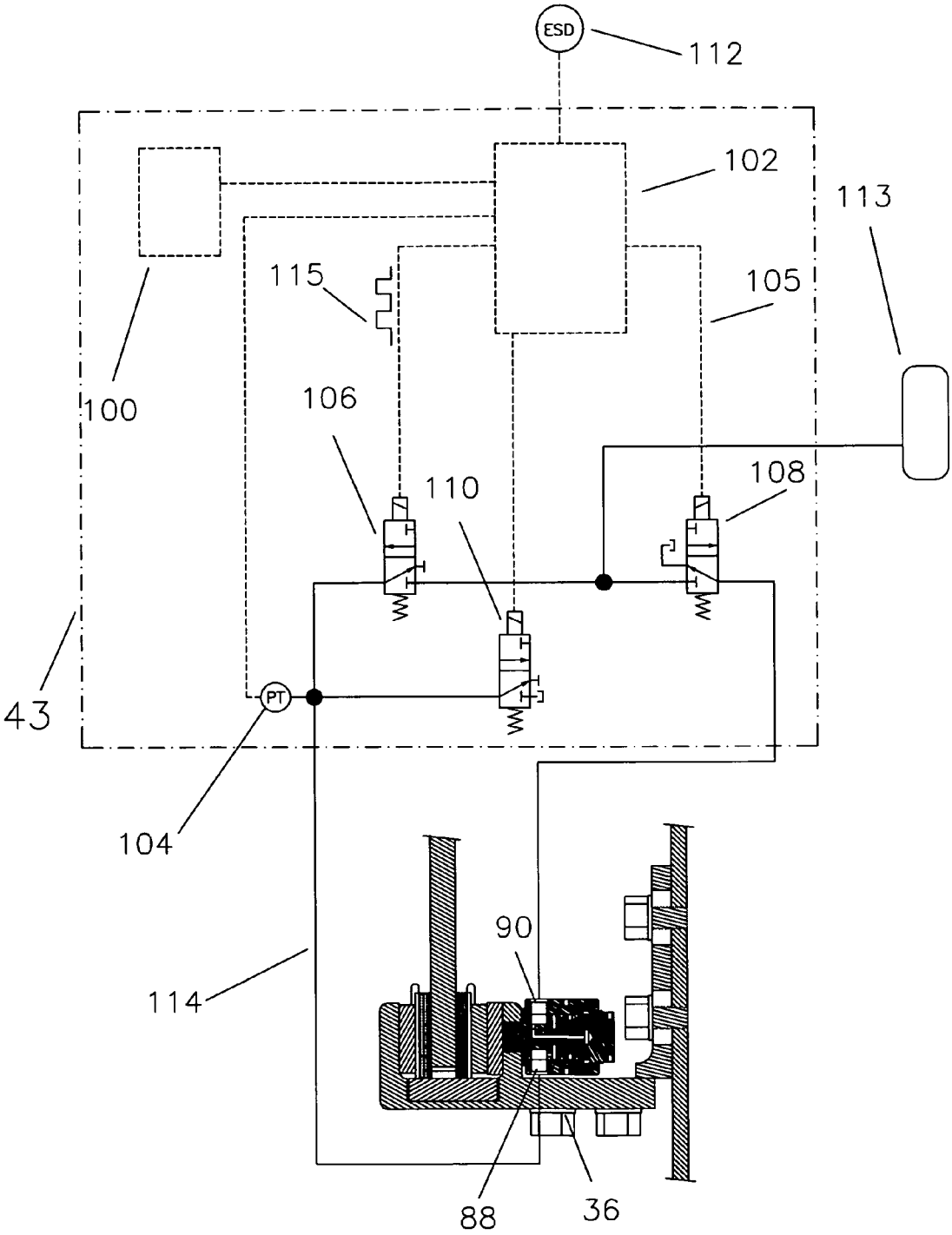
FIG. 5 is a section of a slip clutch assembly with a schematic of the torque adjustment system of this invention.

Referring now to FIG. 5, is a section of a slip clutch assembly 36 with a schematic of the torque controller 37 system which contains a revolution counter 100, a computer 102, a pressure transducer 104, electric lines 105, two pressure increase valves 106 and 108, a vent valve 110, and an emergency shut down button 112. The revolution counter 100 can count the spool 32 revolutions by sensing a passing object, sensing gravity or other means. An air storage tank 113 and connecting air lines 114 will be pressurized prior to operations.

With specific input information on the diameter of spool 32, the width of spool 32 and the diameter of umbilical 18, the row number of the current umbilical being paid off, the number of umbilical wraps on that row, and the desired tension, the computer 102 can calculate the pressure for port 90 required to generate the desired torque. The computer 102 will read the current pressure as indicated on the pressure transducer 104 and compare it to the desired pressure.

The computer 102 will then either send an electronic signal to open the vent valve 110 to reduce the pressure in port 90 or pressure increase valve 106 to increase the pressure to match the desire. Alternately, a pressure regulator as is well understood in the industry may be controlled to maintain the desired pressure in port 90 to produce the required torque on the spool 32 to keep the umbilical 18 tension stable.

If an emergency occurs and emergency shut down button 112 is pushed, it will lock brake pads 80 and 82 on the main disk 34 by putting pressure into port 88 on therefore on the opposite side of the piston 84. This will have the air pressure loading adding to the conical spring 85 loading for an increased friction loading on the main disk 34.

Figure 6:
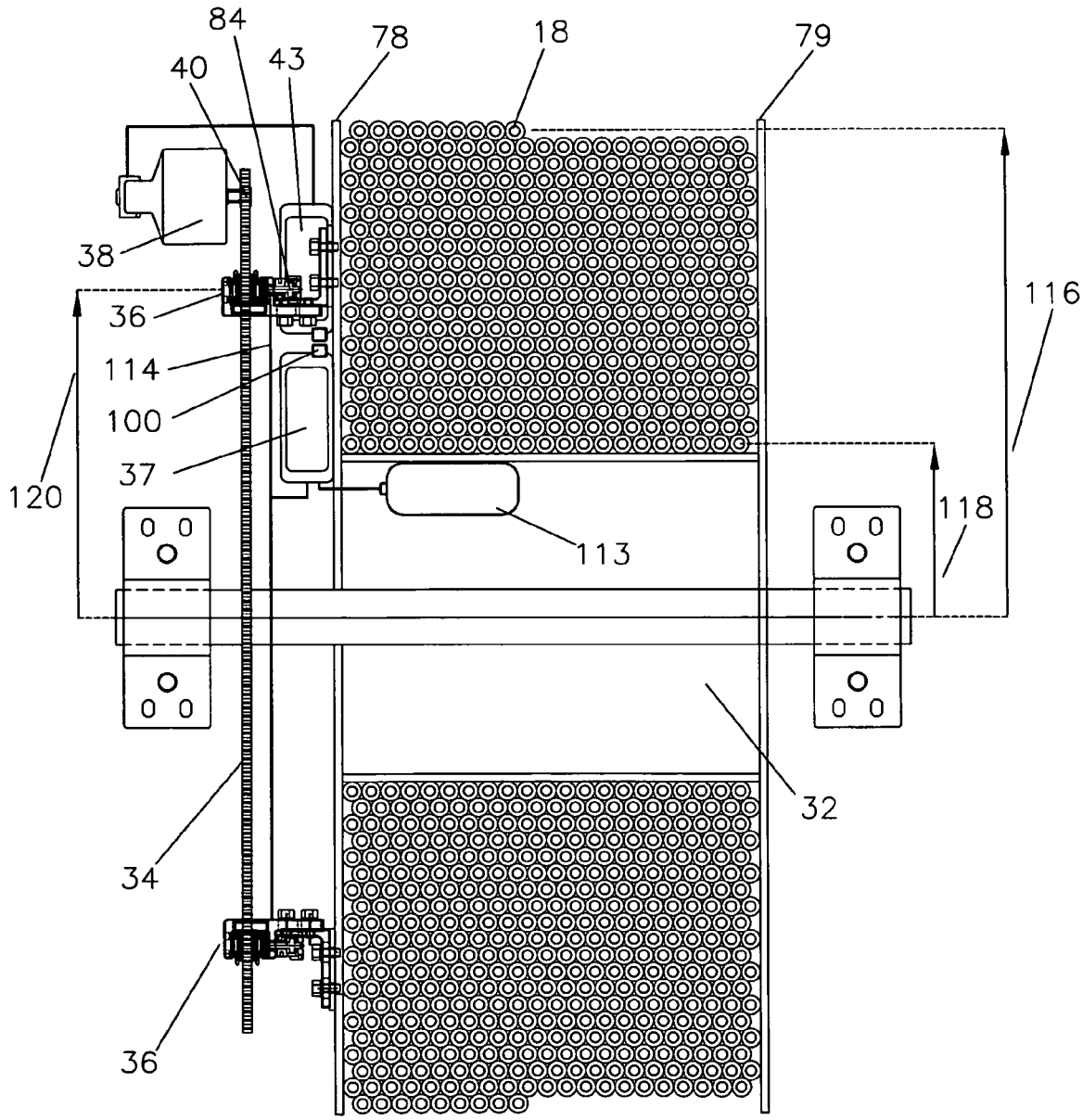
FIG. 6 is a section of a reel of this invention showing the forces and diameters that cause the umbilical tension to vary during deployment.

Referring now to FIG. 6, a section through the reel is generally taken as indicated by section "6-6" on FIG. 2. The slip clutch assemblies are indicated as being mounted at a radius 120 from the centerline of the reel. The umbilical 18 is shown to be paid off at a radius 116 on a full reel and at a radius 118 on a near empty reel. The spool 32 is shown to be 21 umbilical wraps wide. The objective is to control the friction grip on the main disk 34 at the radius 120 such that the slip tension on the umbilical 18 will be the same at the full reel radius of 116 or the empty reel radius of 118. As the radii are different in these situations, the problem is most easily understood in terms of torques about the rotational centerline of the spool.

As a real life example, the problem will be demonstrated in terms of a desired umbilical tension of 1000 lbs., an outer radius 116 of 45 inches, and inner radius 118 of 15 inches, a slip clutch assembly radius 120 of 30 inches, area of piston 84 energized by air is 1.5 sq. in. rig air supply will be at least 120 p.s.i., and a sliding coefficient of friction of 0.3.

The torque generated by the umbilical on the full reel is 45 inches times 1,000 lbs. or 45,000 in-lbs. The total resisting force on the slip assemblies will be determined by 45,000 in-lbs./30 inches or 1,500 lbs. Sliding friction is calculated by the normal force (perpendicular to the surface) time the coefficient of friction. This means that the total normal force will need to be 1,500 lbs./0.3=5,000 lbs. The normal force is divided up between four slip clutch assemblies with friction on two sides each, so the individual required normal force is 5,000 lbs./8=625 lbs. This means that the conical springs 85 as seen on FIG. 4 need to be designed to output 625 lbs. in each of the slip assemblies 36.

The torque generated by the umbilical on a nearly empty reel is 15 inches times 1,000 lbs. or 15,000 in-lbs. The total resisting force on the slip assemblies will be determined by 15,000 in-lbs./30 inches or 500 lbs. This means that the total normal force will need to be 500 lbs./0.3=1,666 lbs. So the individual required normal force is 1,666 lbs./8=208 lbs. As the conical springs 85 as seen on FIG. 4 are designed to output 625 lbs. in each of the slip assemblies 36, 625−208 or 417 lbs. need to be relieved from the slip assemblies 36. As the piston area is 4.00 sq. in and the rig air supply is 120 p.s.i., 4.00 sq. in. times 120 p.s.i.=480 lbs. is available and so is sufficient. The computer will calculate 417 lbs./4.00 sq. in.=104.25 p.s.i. as required and direct pressure increase valve 106 to increase to that pressure or vent valve 110 to vent until the pressure is reduced to that level.

The reel is shown with 9 wraps presently on the outer layer. It will start with zero pressure in port 88 and 90, and then after 9 revolutions of the reel it will increase the pressure in port 88 slightly to compensate for the slight smaller radius on the second layer of umbilical wraps. Twenty one wraps later, it will adjust again as it goes to the next layer.

A similar process happens on the motor torque controller 43, except that it must sense the rotation of the spool 32 from its stationary position on the frame. Based on its determination of the current level of the umbilical on the spool 32, it will adjust the pressure supplied to the motor to give a constant tension on the cable at a lower value than the slip tension, i.e. 750 lbs.

In this way the slip tension and motor tension can be at a desired constant value which are relatively close to one another for maximum equipment and personnel safety.

Figure 7:
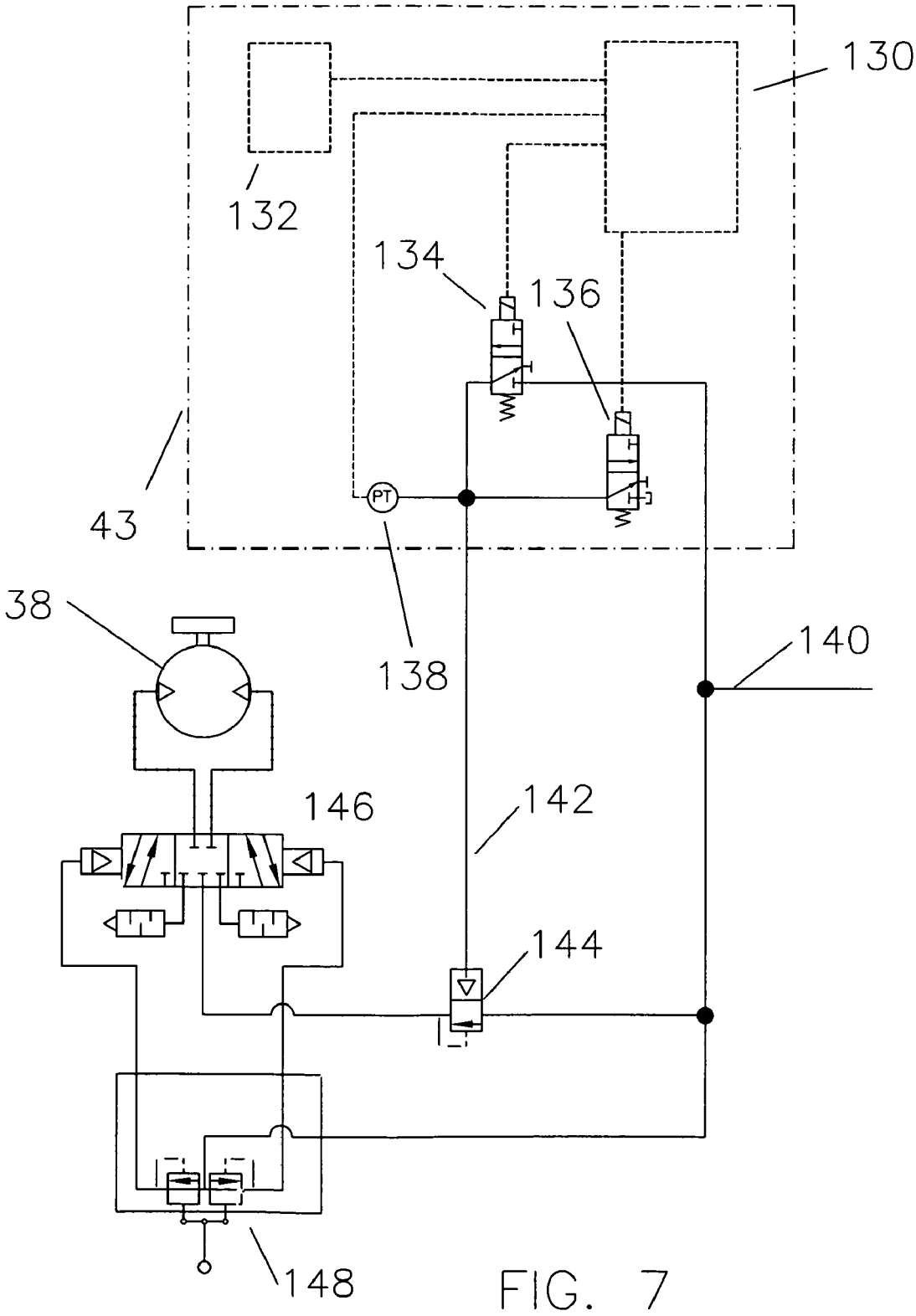
FIG. 7 is a schematic of the motor controller and the motor operating system.

Referring now to FIG. 7, motor torque controller 43 is shown with computer 130, revolution counter 132, pressure increasing valve 134, pressure reducing valve 136 and pressure transmitter 138. Air is supplied to motor torque controller 43 through line 140 and an output signal 142 is sent to the dome regulator 144 to control the pressure sent to the main control valve 146 which in turn sends the signals to motor 38. Manual valve 148 is used to shift the main control valve to change the direction of the motor.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. The method of controlling the maximum tension on an umbilical wrapped on a spool of an offshore reel, comprising
- providing a motor,
- providing brakes,
- providing an adjustable sliding connection operably mounted to said spool which slides when a load on the said adjustable sliding connection exceeds a predetermined load amount,
- providing that said adjustable sliding connection comprises a main disk and one or more sliding pads,
- providing controls which determine an approximate radius between the centerline of said spool and the centerline of the umbilical on said spool as said umbilical leaves said spool,
- controlling an adjustment of the said adjustable sliding connection generally in proportion to said approximate radius to control said maximum tension on said umbilical.

2. The method of claim 1, further comprising determining said approximate radius by counting rotations of said spool.

3. The method of claim 2, further comprising counting said rotations of said spool by sensing a rotation of a weight within said controls.

4. The method of claim 2, further comprising counting said rotations of said spool by a sensor rotating on said spool sensing a stationary object which is not on said spool.

5. The method of claim 1, further comprising providing at least a portion of said predetermined load amount using one or more springs.

6. The method of claim 1, further comprising providing at least a portion of said predetermined load amount using pressure on a piston area.

7. The method of claim 6, further comprising adjusting a magnitude of said pressure as a function of said approximate radius.

8. The method of claim 6, further comprising combining one or more springs and said pressure on a piston area for increasing said maximum tension.

9. The method of claim 1, further comprising controlling at least a portion of said predetermined load amount using pressure on a piston area.

10. The method of claim 1, further comprising utilizing an instrumented load pin to calibrate said adjustable sliding connection.

11. The method of claim 1, further comprising
- providing an automatic controller,
- inputting said maximum tension, spool drum diameter, spool flange outer diameter, spool width, and umbilical diameter to said automatic controller,
- automatically sensing a number of rotations of said spool,
- calculating said adjustment for said adjustable sliding connection required to maintain said maximum tension on said umbilical, and
- automatically adjusting said adjustable sliding connection to maintain said maximum tension as said umbilical is removed from said spool.

12. The method of controlling a maximum tension on an umbilical wrapped on a spool of an offshore reel, comprising
- providing a circular disk with a gear profile on an outer surface,
- providing a motor which engages said gear profile,
- providing brakes which engage said circular disk,
- providing an adjustable sliding connection between said circular disk and said spool which slides when a load on the said adjustable sliding connection exceeds a predetermined load amount,
- providing that said adjustable sliding connection comprises one or more sliding pads,
- providing controls which determine an approximate radius between the centerline of the spool and the centerline of said umbilical on the said spool as said umbilical it leaves the said spool,
- controlling an adjustment of said adjustable sliding connection generally in proportion to said approximate radius to control said maximum tension on said umbilical as said umbilical leaves said spool.

13. The method of claim 12, further comprising determining said approximate radius by counting rotations of said spool.

14. The method of claim 13, further comprising counting said rotations of said spool by sensing a rotation of a weight within said controls.

15. The method of claim 13, further comprising counting said rotations of said spool by a sensor rotating on said spool sensing a stationary object which is not on said spool.

16. The method of claim 12, further comprising providing at least a portion of said predetermined load amount using one or more springs.

17. The method of claim 12, further comprising providing at least a portion of said predetermined load amount using pressure on a piston area.

18. The method of claim 17, further comprising adjusting a magnitude of said pressure as a function of said approximate radius.

19. The method of claim 17, further comprising combining one or more springs and said pressure on said piston area for increasing said maximum tension on said umbilical.

20. The method of claim 12, further comprising controlling at least a portion of said predetermined load amount using pressure on a piston area.

21. The method of claim 12, further comprising utilizing an instrumented load pin to calibrate said adjustable sliding connection.

22. The method of claim 12, further comprising providing an automatic controller, inputting said maximum tension, spool drum diameter, spool flange outer diameter, spool width, and umbilical diameter to said automatic controller, automatically sensing number of rotations of said spool, calculating said adjustment of said adjustable sliding connection required to maintain said maximum tension on said umbilical, and automatically adjusting said adjustable sliding connection to maintain said maximum tension on said umbilical as said umbilical is removed from said spool.

* * * * *